United States Patent [19]

Bayer

[11] 4,107,592

[45] Aug. 15, 1978

[54] AUTOMATICALLY OPERATING SPEED-REGULATED POSITIONING ARRANGEMENT

[75] Inventor: Friedrich Bayer, Stockstadt, Fed. Rep. of Germany

[73] Assignee: Quick-Rotan Becker & Notz KG, Darmstadt, Fed. Rep. of Germany

[21] Appl. No.: 471,034

[22] Filed: May 17, 1974

[30] Foreign Application Priority Data

May 22, 1973 [DE] Fed. Rep. of Germany ..... 2325969

[51] Int. Cl.[2] ..... G05B 19/10

[52] U.S. Cl. ..... 318/568; 318/603; 112/121.11

[58] Field of Search ..... 318/567, 568, 569, 570, 318/574, 603, 571; 112/121.11, 2, 112

[56] References Cited

U.S. PATENT DOCUMENTS

| | | | |
|---|---|---|---|
| 3,613,608 | 10/1971 | Hinerfeld et al. | 318/568 |
| 3,654,882 | 4/1972 | Kamena | 112/121.11 |
| 3,752,098 | 8/1973 | Logan et al. | 318/571 |

*Primary Examiner*—James R. Scott
*Assistant Examiner*—John J. Feldhaus
*Attorney, Agent, or Firm*—Michael J. Striker

[57] ABSTRACT

A machine is comprised of at least one machine part, such as a rotating shaft, which moves cyclically during performance by the machine of first and second operations. The machine also includes a controlled unit which undergoes changes of state for the purpose of initiating and terminating machine operations. A control system for the machine includes a synchronizer for generating synchronizing pulses synchronized with the cyclical movement of the cyclically moving machine part. There is provided a first automatic control arrangement for automatically controlling performance by the machine of the first operation by counting synchronizing pulses generated during such first operation and upon reaching a first predetermined count causing the controlled unit to undergo a change of state, the first automatic control arrangement thereafter becoming inoperative. There is further provided a second automatic control arrangement for automatically controlling performance by the machine of the second operation by counting synchronizing pulses generated during such second operation after such change of state of the controlled unit and upon reaching a second predetermined count causing the first automatic control arrangement to be rendered operative again.

4 Claims, 11 Drawing Figures

AUTOMATICALLY OPERATING SPEED-REGULATED POSITIONING ARRANGEMENT

BACKGROUND OF THE INVENTION

The invention relates to a speed-regulated positioning drive for driving a driven shaft of a machine, such as a sewing machine, according to a predetermined program, with a control arrangement and a shaft position indicator which supplies to the control arrangement synchronizing signals synchronized with the rotation of the shaft.

Such drives are employed in a great variety of applications, for example for the driving of machine tools, coil- and condensor-winding machines or presses, and the like. Such drives have also found use in conjuction with industrial sewing machines. The invention is accordingly explained with respect to an industrial sewing machine, although it is not to be considered necessarily limited thereto.

In the sewing machine art, as in many other branches of manufacturing, there is a long-existing trend to automate to the extent possible all operations which have previously been manually controlled or performed, in order to decrease labor costs and increase production.

SUMMARY OF THE INVENTION

It is an object of the invention to go further in this direction, with respect to the automating of speed-regulated positioning drives. The drive arrangement should be simple and reliable as well as readily adaptable to a great variety of applications. The number of operations which must be manually or otherwise controlled by a human operator should be kept to a minimum.

A positioning drive according to the invention is characterized by the provision of a first automatic control arrangement which, after counting a predetermined number of synchronizing pulses causes a controlled unit to undergo a change of state, and a second automatic control arrangement which, after the change of state of the controlled unit receives the synchronizing pulses and counts them and, after having received a predetermined number of such pulses causes the first automatic control arrangement to be rendered operative anew. When used in conjunction with a sewing machine, for example, the first automatic control arrangement supplies a program for the automatic sewing of end-of-seam seam locks at the beginning and end of a seam, whereas the second automatic control arrangement serves to establish the seam length program. The controlled unit controlled by the first automatic control arrangement, in such case, may be the sewing-direction control unit which is capable of assuming a "forwards" state or alternatively a "backwards" state, in order to cause the sewing machine to sew in either forwards or backwards direction, respectively.

Preferably, the second automatic control arrangement is provided with a storage. A seamstress effects sewing of an initial "model" seam, including a seam lock at the start of the seam and another seam lock at the end of the seam. The number of synchronizing pulses generated during the sewing of the body of the seam, corresponding to the number of stitches in the body of the seam for example, is registered by the just-mentioned storage when there is generated a termination signal, for instance as a result of activation of a manual control by the seamstress. Furthermore, there is provided a program control switch. When this switch is activated, the number of stitches registered on the storage serves, during a subsequent automatic copying of the "model" seam just sewn, as the predetermined number of synchronizing pulses which the second automatic control unit (e.g., the seam length control unit) must receive before it again activates the first automatic control unit (e.g., the seam lock control unit). In other words, first the seamstress sews a "model" seam, during which time the automatic control arrangements automatically register information concerning the dimensions of various parts of the seam. Then, when the program control switch is brought into the "read-out" or "copy" mode, the "model" seam is automatically reproduced.

As another possibility, the second automatic control arrangement (e.g., the seam length control arrangement) can be provided with a permanent programming means, instead of or in addition to the means for registering the dimensions of the model seam during the sewing thereof. In this way, it becomes possible to directly select dimensions of th seam to be automatically reproduced, without having to first sew a "model" seam.

To this end, the control system is preferably such that the first automatic control arrangement (e.g., the automatic seam lock control arrangement), after being rendered operative again by the second automatic control arrangement (e.g., the automatic seam length control arrangement) counts a predetermined number of synchronizing pulses and then causes the controlled unit (e.g., the sewing-direction control unit) to undergo another change of state. In the context of an automatically controlled sewing machine, it would in this way be possible to provide a seam-end-lock not only at the start of the seam but also at the finish of the seam.

According to a further concept of the invention, there is provided program selector means, by means of which the first automatic control arrangement (e.g., the automatic seam lock control arrangement) can be so designed that, after counting a predetermined number of synchronizing pulses and thereupon causing the controlled unit (e.g., sewing-direction control unit) to undergo a change of state, it repeats as often as desired its operation before and/or after the second automatic control arrangement (e.g., seam length control arrangement) performs its respective operation. In the case of an automatically controlled sewing machine, for example, the first automatic control arrangement is a seam lock control arrangement which causes the sewing machine to reverse direction one or more times so as to sew one or more rows of locking stitches at the beginning and/or end of the seam, whereas the second automatic control arrangement may be the automatic seam length control arrangement which automatically controls the number of stitches in the main body of the seam. Accordingly, the first automatic control arrangement can be operative one or a plurality of times prior to initiating sewing of the main body of the seam, for the purpose of causing the sewing machine to sew alternately forwards and backwards a predetermined number of times to form a seam-start lock. Then the second automatic control arrangement, the automatic seam length control arrangement, takes over and controls the sewing of the main body of the seam. Upon completion of the main body of the seam, the first automatic control arrangement (the seam lock control arrangement) becomes operative again for causing the sewing machine to form a seam-finish seam lock by causing the machine to sew a row of stitches in backwards direction or by causing the machine to sew a plurality of rows of seam-locking stitches alternately in forwards and backwards direction, if a more complicated seam end lock is desired.

A second controlled unit (e.g., a thread-cutting unit) can also be provided, becoming automatically activated by the first automatic control arrangement (e.g., the automatic seam lock control arrangement) after the first automatic control arrangement is rendered operative again by the second automatic control arrangement (e.g., by the automatic seam length control arrangement, upon completion of the body of the seam) and in particular after the first control arrangement (e.g., the automatic seam lock control arrangement) has performed its respective function (e.g., caused the row or rows of seam-locking stitches to be sewn at the seam finish, so that the thread is cut when the seam plus the seam-finish locking stitches have all been sewn).

The novel features which are considered as characteristic for the invention are set forth in particular in in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
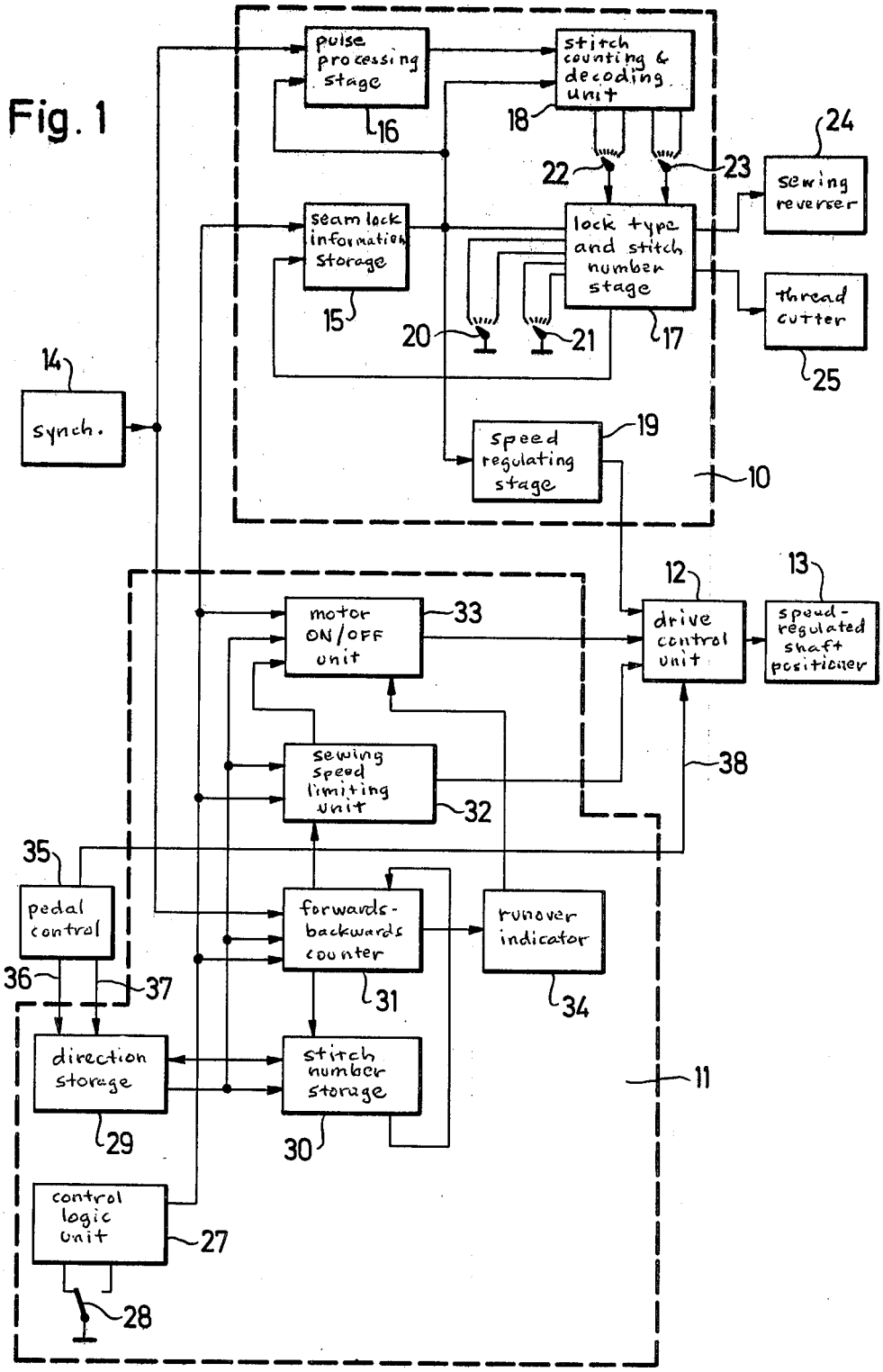
FIG. 1 is a schematic block diagram of one embodiment of the invention, as applied to the control of an industrial sewing machine.

FIG. 1 depicts in schematic block diagram form a system the individual components of which are shown in greater detail in the other Figures. To gain an overall understanding of the system operation, the construction and operation of FIG. 1 will be explained first.

In FIG. 1, numeral 10 designates an automatic seam lock control arrangement operative for controlling the reinforcing or locking stitches at the beginning and end of a seam sewn by an automatically operating sewing machine.

Numeral 11 designates an automatic seam length control arrangement operative for automatically controlling the length of a seam sewn by an automatically operating sewing machine.

The control arrangements 10 and 11 are both cooperatively connected to a control unit 12 which controls the movement of the main driven shaft of a (non-illustrated) sewing machine in conjunction with a speed-regulated shaft-positioning arrangement 13. Such shaft-positioning arrangements are known. For example, they may be comprised of a clutch arrangement controlled by a speed-regulating device. Depending upon the relationship between the desired speed and the actual speed of the main drive shaft of the sewing machine, a driving shaft which drives such main driven shaft is brought into engagement either with a continuously rotating drive motor output shaft or else with a friction brake, so as to thereby either increase or decrease the rotary speed of the main driven shaft of the sewing machine. A position-indicating transducer 14, serving as a synchronizer, generates a pulse each time the main driven shaft of the sewing machine assumes a predetermined angular position. The synchronizer 14 generates one such pulse for each rotation of the main driven shaft of the sewing machine. Such pulse, being synchronized with a predetermined angular position of the main driven shaft of the sewing machine, can be used to stop such main driven shaft in a predetermined angular position, when it is desired to stop the shaft.

Such speed-regulated shaft-positioning arrangements (unit 13 in FIG. 1) are extremely well known in the art, and will not be described in detail here. For example, the unit 13 in FIG. 1 could be any one of the speed-regulated shaft-positioning arrangements disclosed in French Pat. No. 1,583,056 (and corresponding U.S. Pat. No. 3,487,438), in German published application 1,613,350, in German published application 1,763,853 (and corresponding U.S. Pat. No. 3,532,953), and in German Pat. No. 2,054,501 (and in corresponding U.S. Pat. No. 3,761,790), the disclosures of which are incorporated herein by reference. The synchronizer or shaft-position-indicating unit 14 in FIG. 1 can, for example, be the position-indicating unit disclosed in German Pat. No. 1,763,657 (and in corresponding U.S. Pat. No. 3,582,739).

The automatic seam lock control arrangement 10 includes a seam-lock-information storage 15, a pulse-processing stage 16, a seam-lock-type and seam-lock stitch-number evaluating stage 17, a stitch counting and decoding unit 18, and a speed-regulating stage 19 operative during the sewing of seam-locking stitches. As is well known in the sewing machine art, a variety of different types of end-of-seam seam-locking stitch expedients can be resorted to, some examples being shown in FIGS. 2*a* to 2*e*. Moreover, two different types of seam-end locks may be desired for the beginning of the seam and for the end of the seam, respectively.

To select the type of seam-end lock to be sewn at the beginning of the seam (the "seam start lock") there is provided a selector switch 20.

To select the type of seam-end lock to be sewn at the end of the seam (the "seam finish lock"), there is provided a selector switch 21.

The desired number of stitches in the "seam start lock" is set by means of selector switch 22, whereas the desired number of stitches in the "seam finish lock" is set by means of selector switch 23.

Connected to the output of stage 17, and controlled by the latter, is a sewing-direction ("forwards" or "backwards") control unit 24. This is a two-state unit, which causes the sewing machine, when activated, to sew in either forwards or backwards direction. The sewing-direction control unit 24 may comprise an electromagnetically activatable reversing transmission arrangement, or a pneumatically activated reversing arrangement, or the like. Such direction-reversing units are per se very well known in the sewing machine art.

Also connected to the output of stage 17, and controlled by the latter, is a thread-cutting unit 25 which automatically effects thread cutting when the automatically sewn seam has been completed. Such automatic thread-cutting units are known per se. In general, they are comprised mainly of an electromagnetically activatable cutting knife member.

The automatic seam length control arrangement 11 includes a control logic unit 27. The control logic unit 27 has two operating modes, selected by moving control switch 28 to a respective one of its two positions. These two operating modes are described in great detail below.

The arrangement 11 further includes a unit 29 operative for storing information concerning the direction in which sewing is to be performed, a unit 30 operative for storing information concerning the number of stitches to be sewn, a forwards-backwards counter 31, a sewing speed limiting unit 32, a motor on/off stage 33, and a run-over indicator unit 34.

The sewing-direction information storage 29 is connected to a foot-pedal control arrangement 35 of per se known construction. The foot-pedal control arrangement 35 applies to the sewing-direction information storage 29 a first direction signal ("forwards" signal) via the line 36, when the (non-illustrated) foot-pedal of the sewing machine is tilted in forwards direction. In contrast, if the foot-pedal is tilted in rearwards direction, then a second direction signal ("backwards" signal) is applied via line 37 to the sewing-direction information storage 29. Furthermore, the foot-pedal unit 35 generates on line 38 a signal whose magnitude is indicative of the desired speed of rotation of the main driven shaft of the sewing machine, the magnitude of this signal varying in direct dependence upon the extent to which the foot-pedal is tilted in either forwards or backwards direction; such relationship between the speed signal magnitude and the tilting angle of the foot pedal is disclosed, for example, in German published application 1,763,645 and in U.S. Pat. No. 3,778,692. The greater the displacement of the foot-pedal from the "null" position thereof, the greater is the desired-speed signal generated on line 38. The desired-speed signal is applied via line 38 to the drive control unit 12.

The arrangement schematically depicted in FIG. 1 operates in the following manner:

To start with, there is fed into the sewing machine a test specimen of the article to be sewn, and the control switch 28 is moved to the "write-in" position thereof. With switch 28 in the "write-in" position, a seamstress manually activates the various manually activatable sewing machine controls and thereby sews a seam of the desired length having at the ends thereof seam-end locks of the desired type or types with the desired number of end-lock stitches. Information signals corresponding to these seam components are generated and written-in or registered by the various storage units shown in FIG. 1. Subsequently, when control switch 28 is moved to the "read-out" position thereof, the automatic control arrangements 10 and 11 will cause the sewing machine to automatically reproduce, as often as desired, the "model" seam.

Specifically, to sew the initial "model" seam, the foot-pedal of unit 35 is tilted forwards, and a corresponding "forwards" signal is applied via line 36 to sewing-direction information storage 29. The seam-lock-information storage 15 receives the command "start lock". In dependence upon the type of seam-end-lock for which the selector switch 20 has been set, the sewing-direction control unit 24 is caused, by stage 17, to assume the appropriate one of its two stages ("forwards" and "backwards").

The motor control stage 33 causes the control unit 12 to release the hitherto locked-in shaft-positioning arrangement 13. The unit 19 serves to limit the rotational speed of the drive motor during sewing of the "start lock", i.e., during sewing of the seam-end-lock stitches at the beginning of the seam.

As the main driven shaft of the sewing machine rotates, during such sewing of the "seam start lock", the synchronizer 14 generates a pulse train which is applied to the input of the pulse processing stage 16, which in turn applies pulses to the stitch-counting and decoding unit 18. When the stitch counter in unit 18 has received from synchronizer 14 a number of pulses corresponding to the desired number of seam-end-lock stitches, the sewing-direction control unit 14 is caused to undergo a change of state. Depending upon the selected type of seam end lock, a second series of seam-end-lock stitches will be sewn, or else sewing of the body of the seam will immediately commence.

During the sewing of the "seam start lock" of the initial "model" seam, the unit 19, normally operative for limiting the speed at which the seam-end-lock stitches are sewn, is rendered inoperative.

After the "start lock" of the "model" seam has been sewn, the seamstress manually effects sewing of the body of the "model" seam itself. During sewing of the body of the "model" seam, the pulses from synchronizer 14 are applied to the counter 31. The counter 31 registers the number of stitches in the body of the "model" seam.

Next, the foot-pedal of control unit 35 is tilted backwards. By means of the sewing-direction information storage 29, the selector switches 21 and 23, which respectively establish the seam-lock type for the "seam finish lock" and the number of lock stitches in the "seam finish lock," are activated. The sewing-direction control unit 24 undergoes another change of state. The "seam finish lock" is sewn, and the pulses from synchronizer 14 are applied to the previously reset counter 18. Upon completion of the "seam finish lock," the thread cutter 25 is activated and the speed-regulated shaft positioning unit causes the main driven shaft of the sewing machine to stop.

To now cause the machine to reproduce this just-sewn "model" seam on the next article fed into the sewing machine, the control switch 28 is moved to its "read-out" or "copy" position. The information which was fed into the counter 31 during the sewing of the "model" seam, and indicating the number of stitches in the "model" seam, is now applied to and registered by a stitch-number storage 30. After sewing of the "seam start lock," the pulses from synchronizer 14 are applied to the backwards input of the forwards-backwards counter 31. The count on counter 31 decreases from the number registered by stitch-number storage 30 down to zero, whereupon after backwards tilting of the foot-pedal the automatic seam lock control arrangement 10 effects sewing of the "seam finish lock".

If, during the sewing of the "model" seam, the number of pulses applied to the counter 31 and indicative of the length of the seam happens to exceed the counting capacity of counter 31, then the run-over indicator unit 34 indicates this. The unit 32 for limiting the sewing speed causes sewing of the last stitches of the automatically sewn seam to proceed at a decreased speed, i.e., at a decreased rotary speed of the machine drive, to prevent the sewing machine from sewing more stitches than called for by the program as a result of the inertia of the sewing machine drive.

FIGS. 3–6 depict circular details of the arrangement schematically depicted in FIG. 1.

To set up the arrangement of FIGS. 3–6, the selector switch 20 (FIG. 6) is moved to a position corresponding to the type of seam lock desired for the "seam start lock". Likewise, the selector switch 21 (FIG. 6) is moved to a position corresponding to the type of seam lock desired for the "seam finish lock." The ten-position switch 22 is set to a position corresponding to the desired number of seam-end-lock stitches for the "seam start lock," whereas the ten-position switch 23 is set to a position corresponding to the desired number of seam-end-lock stitches for the "seam finish lock". The "write-in" and "read-out" selector switch 28 (FIG. 3) is maintained in its middle or neutral position.

When the circuitry of FIGS. 3–6 is connected to the supply voltage, then at the time of such connecting, the circuit stage 51 (FIG. 3) generates a short-lasting "0" signal on the line 52, thereby setting all the components of the illustrated arrangement to predetermined output states. Specifically, the sewing-direction information storage 29 (FIG. 3), here composed of two cross-coupled NAND-gates 53, 54 forming a sewing-direction information-storing flip-flop, is caused to assume the "backwards" state. A flip-flop comprised of the NAND-gate 55,56, and forming part of the run-over indicator 34, is caused to assume the "no run-over" state. The motor on/off switching stage 33 (FIG. 4) is formed by a motor-flip-flop comprised NAND-gates 57, 58 and is caused to assume the "turn off drive" state. The sewing speed limiting stage 32 (FIG. 4) is comprised of a flip-flop formed by NAND-gates 59, 60 and is caused to assume the "no speed limiting" state. A flip-flop comprised of NAND-gates 61, 62 forms part of the seam-lock-information storage 15 (FIG. 1) and determines whether a "seam start lock" or a "seam finish lock" is sewn; it is caused to assume the state corresponding to "seam finish lock". Via a NAND-gate 63 (FIG. 6), a conductor 64 (extending from the output of NAND-gate 63 in FIG. 6, then across FIG. 5, into FIG. 4), and an inverter 65, a flip-flop 66 (FIG. 5) which also forms a part of the seam-lock-information storage 15 (FIG. 1) is caused to assume the "no seam lock" state, in order to prevent an erroneous sewing of a seam-end lock when the circuitry of FIGS. 3–6 initially becomes connected to the supply voltage.

Next, the control switch 28 (FIG. 3) is moved to the illustrated upper position thereof, i.e., to the "write-in" position thereof. A sample specimen is fed into the sewing machine, in order to sew a "model" seam on such sample specimen, for later automatic copying under the control of the automatic control arrangements 10 and 11.

Figure 4:
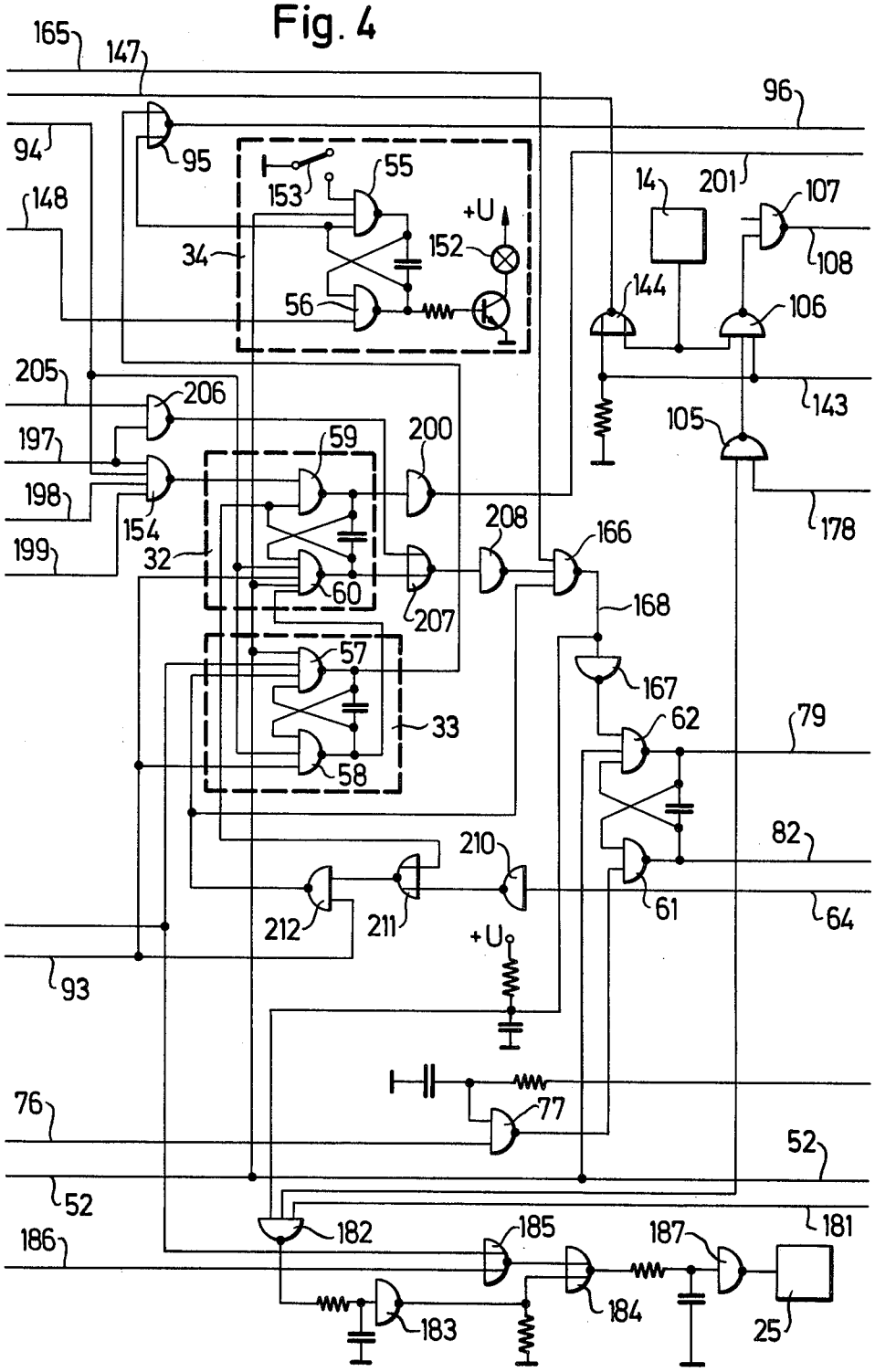
Figure 5:
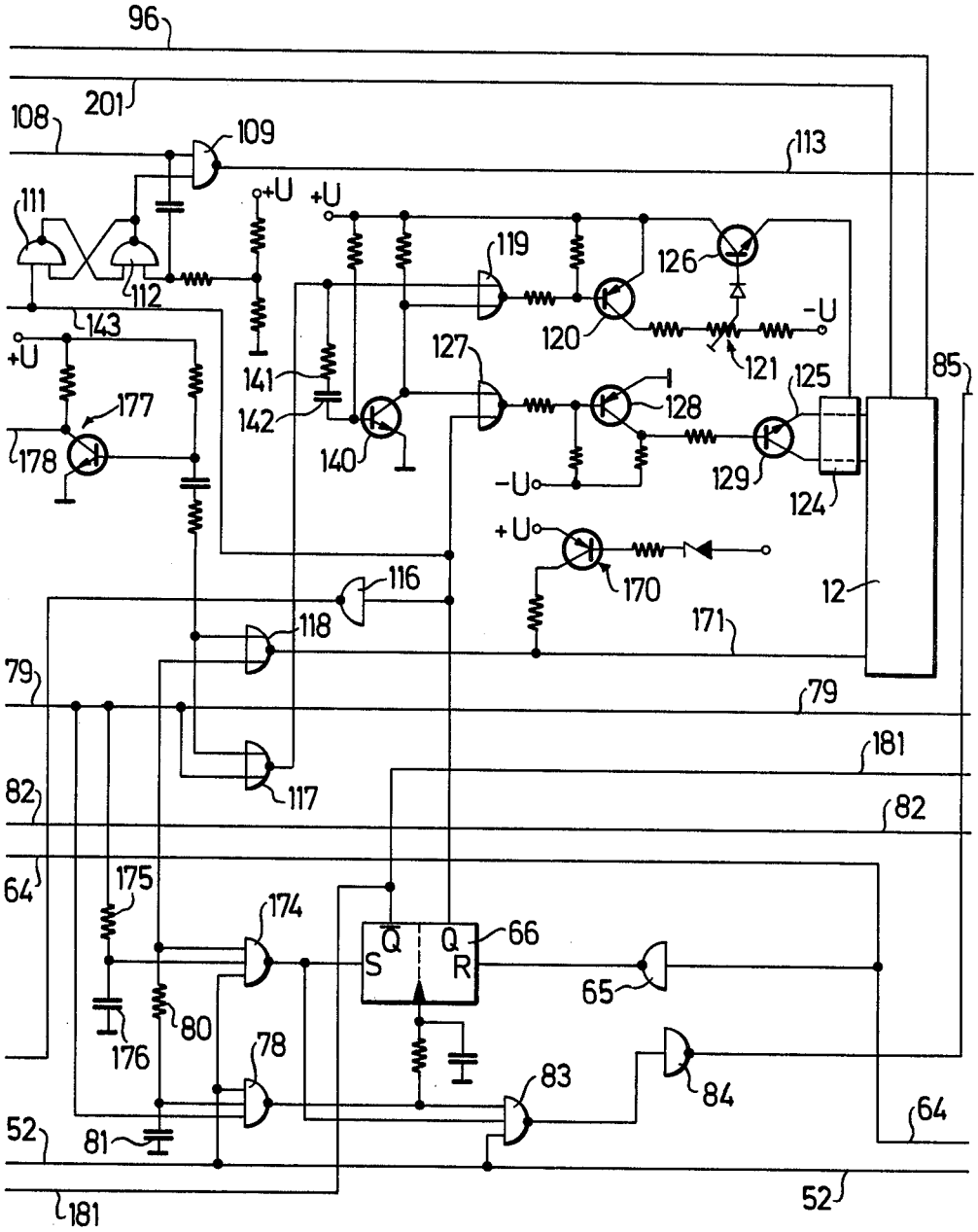

Next, the sewing machine foot-pedal is tilted forwards, thereby opening a normally-closed switch 70 (FIG. 3) forming part of the foot-pedal control unit 35 (FIG. 1). As a result, there appears at the output of inverter 71 (FIG. 3) an "0" signal, thereby causing sewing-direction-information-storing flip-flop 53, 54 to undergo a transition to the "forwards" state, the output signal of NAND-gate 54 becoming a "1", and the output signal of NAND-gate 53 becoming a "0". Due to the time delay associated with an RC-circuit stage 72, 73 connected to the output of NAND-gate 53, for a brief time after the sewing-direction flip-flop 53, 54 undergoes the just-mentioned change of state, "1" signals are applied to both inputs of a NAND-gate 74. There appears at the output of NAND-gate 74 a negative pulse ("0" signal) which is applied, via an inverter 75 and a line 76 to one input of a NAND-gate 77 (FIG. 4). As a result, a "1" signal appears at the output of NAND-gate 77, thereby causing the flip-flop 61, 62 to undergo a transition to the "seam start lock" state. The lower input of a NAND-gate 78 (FIG. 5) is connected via a line 79 directly to the output of NAND-gate 62 (FIG. 4), whereas the middle input of NAND-gate 78 (FIG. 5) is connected to the output of NAND-gate 61 (FIG. 4) via a line 82 and an RC-time-delay stage 80, 81 (FIG. 5). Accordingly, when the flip-flop 61, 62 undergoes the change of state, there appears at the output of NAND-gate 78 (FIG. 5) a negative pulse, which is applied to the trigger input of flip-flop 66 causing the latter to assume its "seam lock" state. A "1" signal appears at the Q output of flip-flop 66. The "0" signal at the output of NAND-gate 62 (FIG. 4) is also applied, via the NAND-gate 78 (FIG. 5), via a NAND-gate 83 (FIG. 5), via an inverter 84 (FIG. 5), via a line 85, and via a NAND-gate 86 (FIG. 6), to reset input of a counter 87 which counts seam-end-locking stitches and which forms part of the stitch counting and decoding unit 18 (FIG. 1), thereby resetting counter 87 to zero. Additionally, the flip-flops 88 and 89, belonging to the pulse processing stage 16 of FIG. 1, are reset by the brief pulse transmitted via the line 85.

The negative pulse at the output of NAND-gate 74 (FIG. 3) is furthermore applied to the lower input of a NOR-gate 90 (FIG. 3), the upper input of which is connected to ground by the control switch 28, and from there to the erase inputs "cl" of two four-bit counters 91, 92 which count the seam stitches and are included in the forwards-backwards counter 31 (FIG. 1); as a result, the counters 91, 92 are set to zero.

Furthermore, the negative pulse at the output of NAND-gate 74 (FIG. 3) is applied via line 93 to the motor-flip-flop 57, 58 (FIG. 4), flip-flop 57, 58 having previously been set to the "turn on motor" state by means of the control switch 28 and the line 94. Via a NOR-gate 95 and the line 96 the motor-flip-flop 57, 58 releases the initially blocked drive control unit 12 (FIG. 5). The flip-flop 59, 60 remains in the "no sewing-speed-limiting" state.

It will be assumed that the switch 20 (FIG. 6) is in the illustrated left position and that, in consequence thereof, the sewing of the "seam start lock" is programmed as a half lock. As shown in the schematic diagram of FIG. 2*a*, such a half lock is comprised of a series of stitches 97 sewn in backwards direction, followed by the sewing of stitches 98 in the forwards direction, i.e., in the actual direction of the sewing of the body of the seam.

By means of a switch 20 a "1" signal is maintained at the output of a NAND-gate 101 (FIG. 6), because, during the sewing of the "seam start lock," there will simultaneously exist on the line 82 a "1" signal from the lower output (NAND-gate 61) of flip-flop 61, 62. An inverter 102 (FIG. 6) has an input connected to the output of NAND-gate 101 and an output connected to the lower input of an exclusive OR-gate 103, to which is accordingly applied a "0" signal.

The reset pulse on line 85 triggered by change of state of flip-flop 61, 62 resets the flip-flop 88 so that there is a "0" signal at the Q output of flip-flop 88; accordingly there is a "0" signal at the output of exclusive OR-gate 103. As a result, during the sewing of the seam-end lock 97 (FIG. 2*a*), there is a "1" signal at the output of a NOR-gate 104 (FIG. 6) whose lower input is connected to the output of gate 103. This "1" signal is applied to the input of the sewing-direction control unit 24; for example, the principal component of the unit 24 could be an electromagnetic moving means which is in actuated condition when unit 24 receives a "1" signal and which is in unactuated condition when unit 24 receives a "0" signal, because a "1" signal is applied to the input of sewing-direction control unit 24, the seam-end-locking stitches are sewn in backwards direction, when now, on account of the release of the drive control unit 12 caused by the change of state of motor-flip-flop 57, 58, the sewing machine begins to sew.

With the main driven shaft of the sewing machine now turning in the backwards direction, the synchronizer 14 (FIG. 4) begins to generate a pulse train each pulse of which corresponds to the completion of one revolution of the main driven shaft of the sewing machine, and accordingly to the sewing of one stitch.

Figure 6:
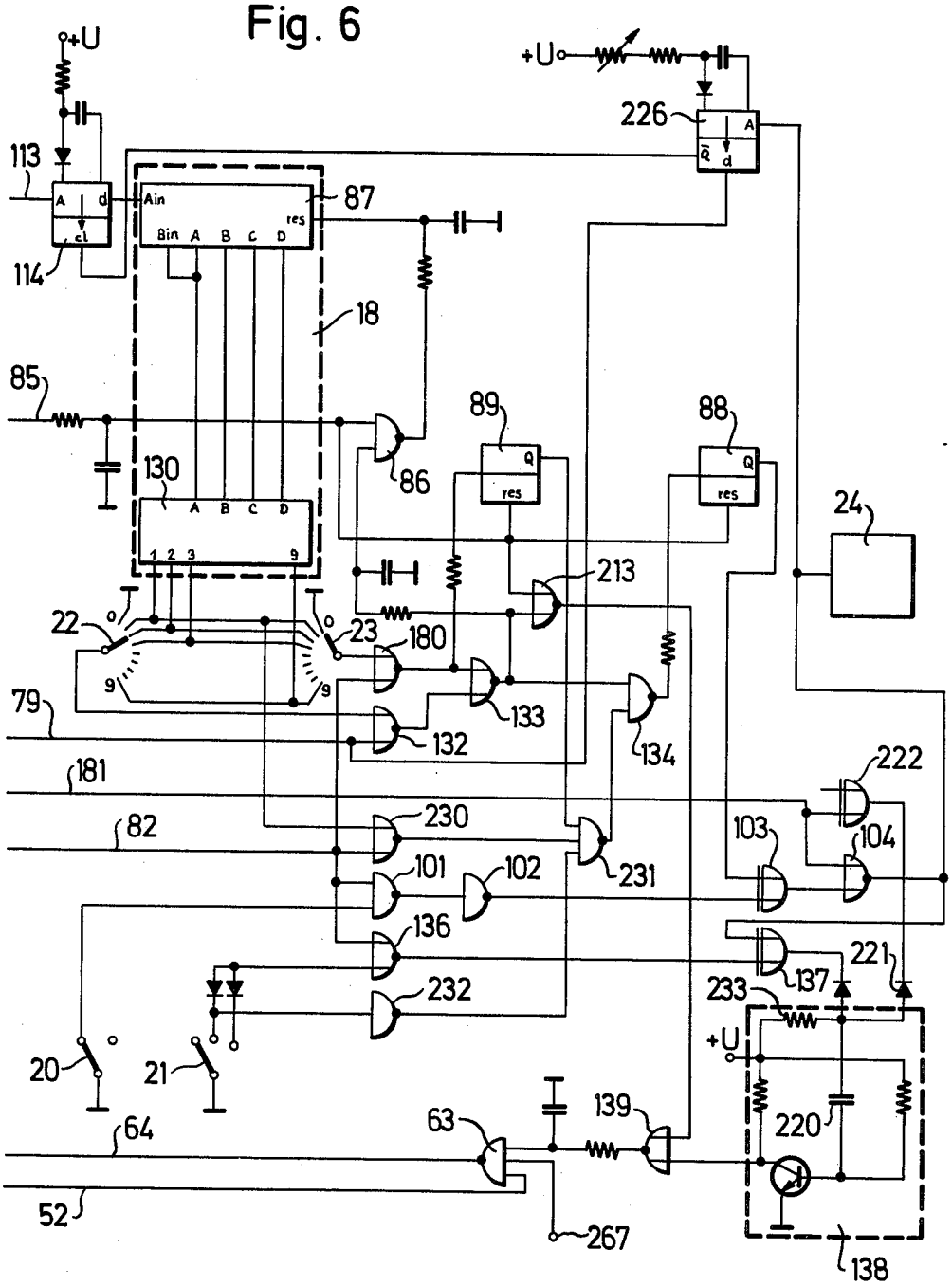

During the sewing of the "seam start lock" there is a "0" signal at the output of NAND-gate 62 (FIG. 4), and accordingly the NAND-gate 105, whose left input is connected to the output of NAND-gate 62, will be maintained blocked. As a result, the pulses from the synchronizer 14 can pass through a NAND-gate 106. These pulses are then applied to the lower input of a NAND-gate 107 and via a line 108 to the upper input of a NAND-gate 109. The first synchronizing pulse appearing at the output of gate 107 sets a flip-flop comprised of NAND-gates 111, 112. As a result, the flip-flop 111, 112 unblocks the NAND-gate 109, so that the next synchronizer pulse can pass through the NAND-gate 109. The last-mentioned synchronizer pulse and the subsequent synchronizer pulses are applied via a line 113 to the input A of a monostable multivibrator 114 (FIG. 6). The monostable multivibrator 114 passes the thusly received synchronizer pulses on to the input of the seam-end-locking-stitch counter 87. The monostable multivibrator 114 serves as a pulse shaper, imparting to the received synchronizer pulses constant amplitude and pulse duration, in order to prevent the seam-end-locking-stitch counter 87 from interpreting a flat pulse flank as being more than one pulse.

The "1" signal at the output Q of flip-flop 66 (FIG. 5) is inverted by an inverter 116 and applied to NOR-gates 117 and 118 (FIG. 5). There is at the output of NOR-gate 117 a "1" signal for the "seam start lock." The "1" signal at the output of NOR-gate 117 causes a "0" signal to exist at the output of a NOR-gate 119, as a result of which transistor 120 is conductive. A voltage divider 121 is connected at its left end to positive potential, via the now-conducting transistor 120, and is connected at its right end to negative potential.

The drive control unit 12 (see FIG. 5) has an input connected to the output of a unit 124 for establishing the desired value of the sewing speed, i.e., of the rotational speed of the main driven shaft of the sewing machine, the unit 124 forming part of the foot-pedal control unit 35 of FIG. 1. In per se known manner, the unit 124 furnishes a voltage whose magnitude is dependent upon the angular depression of the tilting foot-pedal. This voltage appears on the terminal 125. If, during the sewing of the "seam start lock," the voltage indicating the desired sewing rotational speed is more negative than the base voltage of a transistor 126, the base of which is connected to the wiper of adjustable voltage divider 121, transistor 126 becomes conductive. The transistor 126 in this way limits the rotational speed for the sewing of the "seam start lock". Additionally, a "0" signal appears at the output of a NOR-gate 127 one input of which is connected to the output Q of flip-flop 66. As a result, transistor 128 becomes conductive. The emitter-collector path of transistor 128 is connected in parallel to a (non-illustrated) limiting unit which limits the sewing speed during the sewing of the seam. The now conducting transistor 129 short-circuits this sewing-speed-limiting unit and thereby renders the limiting unit inoperative during the sewing of a seam end lock.

Connected to the outputs of the four-bit counter 87 (FIG. 6) for the seam-end-locking stitches are the inputs of a demultiplexer or decoder 130, the outputs of which are in turn connected to the various stationary contacts of the selector switches 22 and 23.

Now, if the synchronizing pulses counted by counter 87 and decoded (e.g., converted from binary to decimal form) in the decoder 130 reach a number corresponding to the setting of selector switch 22, i.e., corresponding to the desired number of stitches for the "seam start lock," a "1" signal becomes applied to the upper input of NOR-gate 132, which is connected to the moving contact of of selector switch 22. As a result the NOR-gate 133 is triggered, and via a NAND-gate 134 the flip-flop 88 is caused to undergo a change of state. By way of the gates 103, 104 there is applied to the input of the sewing-direction control unit 24 a "forwards" command signal. Accordingly, the sewing machine undergoes a transition to forwards operation. Additionally, by way of the gate 86 the locking stitch counter 87 is reset to zero. Since for the "seam start lock" there is a "1" signal on the line 82, there is a "0" signal on the output of a NOR-gate 136 during this time period. Now, if the signal applied to the input of sewing-direction control unit 24 changes from "1" to "0", the output signal of exclusive OR-gate 137 changes from "1" to "0". A monostable multivibrator 138 furnishes a pulse to a NOR-gate 139 which via the gate 63 and the line 64 causes the flip-flop 66 to undergo a transition to the "no seam lock" state thereof. A "0" signal appears at the output Q of the flip-flop 66. By way of the gate 117 a transistor 140 is rendered conductive, the transistor 140, in conjunction with an RC-relay stage 141, 142, serving to maintain the drive rotational speed limited for a certain additional time period, for example 60 ms. Upon elapse of this time period, the transistors 126 and 129 become non-conductive, and the speed-limiting action for the sewing of the "seam start lock" terminates.

By way of a line 143 connected to the output Q of the flip-flop 66, a hitherto blocked NOR-gate 144 is unblocked for the passage of the pulses from synchronizer 14. In correspondence to the position of the control switch 28 (FIG. 3) and by way of an inverter 145 (FIG. 3) a NAND-gate 146 is unblocked. In consequence thereof, the pulses from synchronizer 14 travel via line 147 through NAND-gate 146 to the forwards-count input (designated "up") of the seam stitch counter 91, 92, as soon as the NOR-gate 144 (FIG. 4) is unblocked via the line 143 (FIGS. 4 and 5).

In the illustrated embodiment, the maximum number of stitches for the pre-programmed "model" seam is $2^8 = 256$ stitches. If the stitch number exceeds this value, then there appears on line 148 (FIG. 3) a carry pulse which is applied to the input of NAND-gate 56, causing run-over flip-flop 55, 56 to undergo a change of state. By way of the NOR-gate 95 and the line 96 the drive is blocked. To visually indicate the malfunction, a signal lamp 152 lights up. A reset button 153 (FIG. 4) must be pressed, before the seam length can be written-in and registered anew.

In order to prevent activation of the sewing rotational speed limiting unit 32 during the writing-in of the seam length, i.e., during the initial sewing of the "model" seam, a NAND-gate 154 connected to the input of speed-limiting flip-flop 59, 60 is blocked by way of the switch 28 and the line 94.

The "model" seam is now sewn at a freely selected speed determined by the angular tilting displacement of the foot pedal.

When the end of the "model" seam being sewn on the sample specimen is reached, the seamstress tilts the foot pedal backwards. As a result, the normally closed switch 70 (FIG. 3) closes, whereas a further normally closed switch 156 (FIG. 3) also associated with the foot pedal control arrangement 35 opens. By way of an inverter 157 the sewing-direction flip-flop 53, 54 is caused to undergo a transition to its "backwards" state. The NAND-gate 158 has one input connected to and RC-delay stage 159, 160 corresponding to the RC-delay stage 72, 73. There appears at the output of NAND-gate 158 a pulse which is inverted by way of a NOR-gate 161, the upper input of which is connected to ground by way of control switch 28. The "1" signal at the output of NOR-gate 161 causes the number registered on seam stitch counters 91, 92 during the sewing of the "model" seam to be transferred into the stitch-number storage 30, comprised of two four-bit storages 162, 163.

Figure 3:
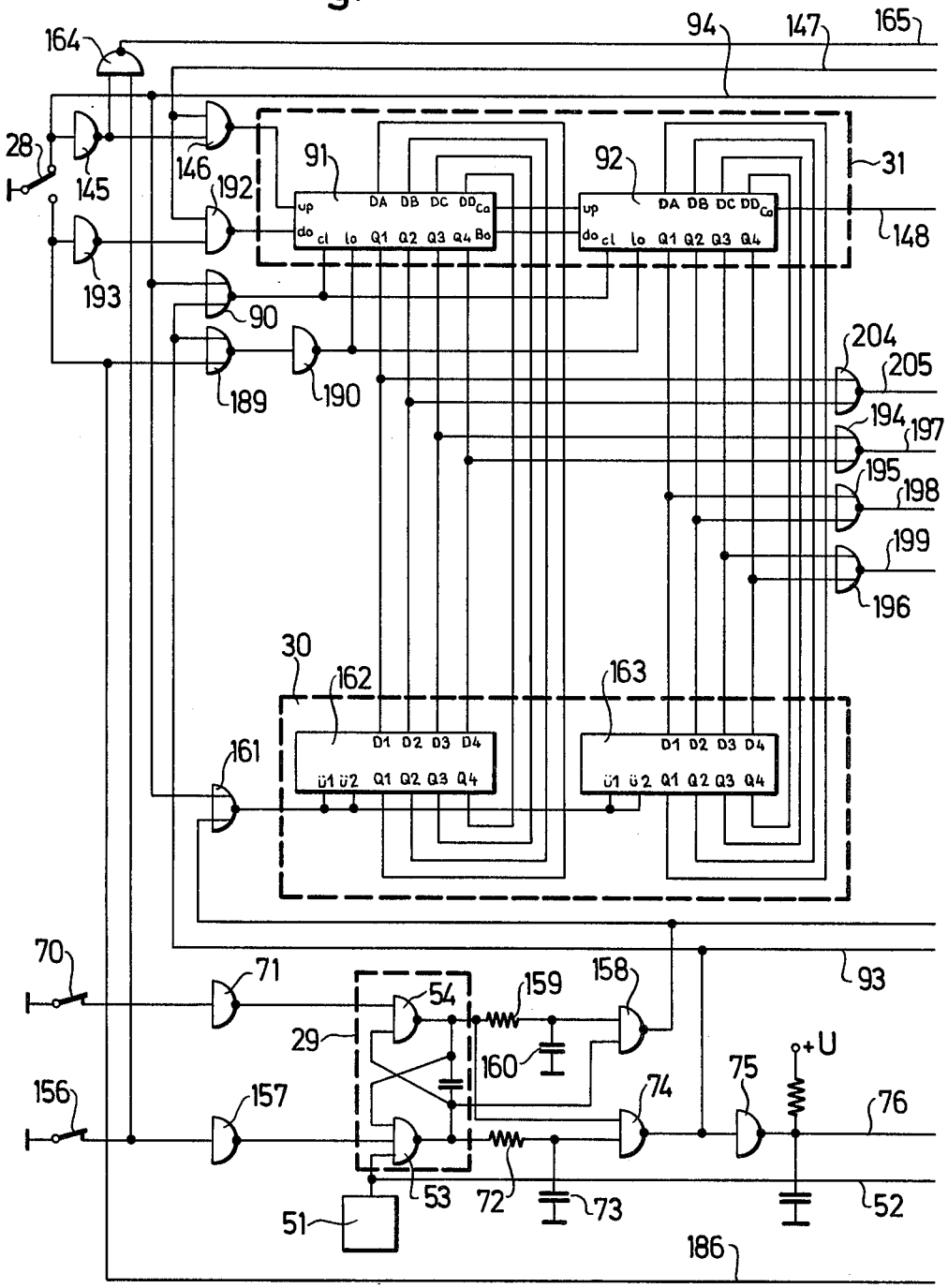
FIGS. 3–6 depict in detail the circuit shown only schematically in FIG 1.

The "backwards" signal generated by opening of the normally closed switch 156 (FIG. 3) is applied to a NAND-gate 166 (FIG. 4) by way of a NAND-gate 164 (FIG. 3) whose left input is at level "1" and by way of a line 165 (FIG. 3). At the output of the gate 166 there appears a positive pulse (a "1" signal) which, by way of a line 168 and an inverter 167 causes the NAND-gate 62 (FIG. 4) to trigger the flip-flop 61, 62 into the "seam finish lock" state thereof. There exists a "1" signal on line 79, and a "0" signal on line 82. In contrast to the operation during the sewing of the "seam start lock," the output of gate 118 (FIG. 5) now assumes the logic level "1". As a result, a unit 170 for indicating the desired rotary operating speed is rendered operative, the unit 170 so controlling the operation of the drive control unit 12 via the line 171 that the "seam finish lock" is sewn at a predetermined speed.

When the flip-flop 61, 62 undergoes a transition to the "seam finish lock" state, there appears a pulse at the output of NAND-gate 174 (FIG. 5) the upper input of which is directly connected to the line 82, whereas the middle input of gate 174 is connected with the line 79 via an RC-time-delay stage 175, 176. This pulse sets the flip-flop 66 by way of the set input S thereof to the "seam lock" state; the output Q of the flip-flop 66 assumes the logic level "0". This triggers a monostable multivibrator 177 which, via a line 187 and the gate 105, blocks the transmission of pulses from synchronizer 14 for a predetermined time interval. This predetermined time interval is long enough to ensure that there occurs a decrease of the drive rotary speed of the sewing machine from the speed employed during the sewing of the seam 98 down to the desired sewing speed for the sewing of the seam end lock, before the pulses from the synchronizer are passed on to the line 113.

It will be assumed that at the seam finish, just like at the seam start, a half seam end lock is to be formed. Accordingly, corresponding to the schematic illustration in FIG. 2*b*, after sewing in the forward direction the stitches 98 of the body of the seam, there should be sewn in the backwards direction a series of seam end locking stitches 179. To this end, the selector switch 21 (FIG. 6) is earlier put into its leftmost position, whereas the selector switch 23 is earlier set to a position corresponding to the desired number of stitches for the "seam finish lock" 179. Due to the existence of an "0" on the line 82, there exists at the output of gate 101 a "1" signal, so that by way of the inverter 102 a "0" signal is applied to the lower input of the gate 103. As a result of the change of state of flip-flop 61, 62, a reset pulse is applied to the line 85. The flip-flop 88 is set to zero, so that both inputs of the exclusive OR-gate 103 are now at logic level "0". In consequence, the logic level at the output of gate 103 changes to "1;" as a result, the sewing-direction control unit 24 is caused to assume its "backwards" state.

The "seam finish lock" is now sewn in a manner analogous to that already described with respect to the "seam start lock". When the number of stitches desired for the "seam finish lock", as indicated by the setting of selector switch 23, is reached, the flip-flop 88 is caused to undergo a change of state, by way of a NOR-gate 180 and the gates 133, 134. The sewing-direction control unit 24 undergoes a transition to its "forwards" state. Additionally, the monostable multivibrator 138 is triggered. As a result, there is produced a seam-lock termination pulse. This pulse travels, by way of the gates 139 and 63, the line 64 and the inverter 65, to the reset input R of the flip-flop 66. The output $\overline{Q}$ of the flip-flop 66 assumes logic level "1". The drive is stopped. The foot-pedal remaining tilted in forwards direction, a NAND-gate 182 is caused to undergo a change of state, by way of the line 181 connected to the output $\overline{Q}$ of flip-flop 66, thereby applying a "cut thread" command signal via an inverter 183 in the form of a "1" signal to the input of a NOR-gate 184. The "cut thread" command signal can pass through the gate 184, since the NOR-gate 185, whose output is connected to the upper input of gate 184, has at its lower input a "1" signal applied thereto by way of a line 186 leading to the control switch 28. The output signal of the gate 184 is inverted by means of an inverter 187 and applied to the thread-cutting control unit 25 of the sewing machine. The thread is accordingly cut off. The additional coupling of the gate 164 (FIG. 3) assures that during the "write-in" operation a static "1" signal is maintained by way of the gate 166 (FIG. 4) for the "cut thread" pulse.

Upon completion of the above-described sewing of the original "model" seam, the control switch 28 is moved to its "read-out" or "copy" position (the lower position as viewed in FIG. 3), in order to preserve the stored seam length information for the automatic control of the subsequent automatically performed seam-sewing operations.

The automatically performed seam-sewing operation proceeds as follows:

Firstly, an article of clothing, or the like, is fed into the sewing machine.

The foot pedal of the sewing machine is tilted forwards, thereby opening the normally closed switch 70 and causing the sewing-direction information-storing flip-flop 53, 54 to undergo a change of state in the manner already described with respect to the "write-in" operation. At the output of gate 74 there appears a "0" signal which is applied to a NOR-gate 189, the lower input of which is now connected to ground by way of control switch 28. The output of gate 189 changes to logic level "1". By way of an inverter 190, a loading pulse is applied to the loading input "1o" of the seam stitch counters 91, 92. As a result, the information registered in the storages 162, 163 is transferred into the counters 91, 92. The pulse travelling out from the gate 74 via the line 93 sets the motor-flip-flop 57, 58 to the "turn drive on" state. The speed-limiting flip-flop 59, 60 is set to the "no speed limiting" state. A trigger pulse travels via line 76 and is applied to the automatic seam lock control arrangement 10, as a result of which the "seam start lock" 97 is sewn in the aforedescribed manner.

After the "seam start lock" has been sewn, the gate 144 (FIG. 4) is unblocked, so that the synchronizer pulses are now applied to the "backwards" input of counter 91, 92, via the line 147 and a NAND-gate 192 which is now unblocked, by reason of switch 28 being in the "read-out" of "copy" position and further by means of an inverter 193. The synchronizer output pulses are now counted backwards, i.e., are now subtracted from the number initially registered in counter 91, 92 and representing the length of the "model" seam, until the stitch count registered by counter 91, 92 has decreased to a predetermined value, 003 in the exemplary embodiment. Upon reaching this value, "1" signals appear at the outputs of NOR-gates 194, 195, and 196. These "1" signals are applied via lines 197, 198, 199 to the gate 154, the second highest input of gate 154 being connected to line 94 and accordingly maintained at logic level "1". Accordingly, the output signal of gate 154 changes from "1" to "0". The speed-limiting flip-flop 59, 60 undergoes a transition to the "speed limiting" state. By way of an inverter 200 and a line 201, a signal is applied to the drive control unit 12. The rotary speed of the sewing machine is reduced for the last stitches of the main body 98 of the seam. In this way, it is assured that when the end of the seam is reached the sewing machine will not overshoot the preprogrammed stitch number on account of the inertia of the rotating parts of the sewing machine.

The sewing machine now sews, at reduced speed, three further stitches, i.e., sews until the count registered in the counters 91, 92 is "000". There then appears at the output of a NOR-gate 204 a "1" signal which is applied via a line 205 to a NAND-gate 206. Since there is applied via the line 197 a "1" signal also to the lower input of gate 206, there appears a "0" signal at the output of gate 206. This signal is applied to a NOR-gate 207. The NOR-gate 207 had previously been unblocked, by means of the speed-limiting flip-flop 59, 60 connected to the lower input of NOR-gate 207, upon reaching of the stitch count $x$-3 (i.e., three stitches before the programmed number of stitches $x$). By way of an inverter 208 and the gate 166, a seam end signal is applied to the line 168 leading to the automatic seam lock control arrangement 10.

When the foot pedal is now tilted backwards, the automatic seam lock control arrangement 10 causes the "seam finish lock" 179 to be sewn in the aforedescribed manner. After the "seam finish lock" 179 has been sewn, a seam lock termination pulse appears on line 64 and is applied via an inverter 210 in the form of a "0" signal to a NOR-gate 211. The upper input of this gate is unblocked by the speed-limiting flip-flop 59, 60. The positive output pulse ("1" signal) of gate 211 is inverted by the AND-gate 212 and sets the motor-flip-flop 57, 58 to the "turn off drive" state. By way of the gate 95 and the line 96 a "0" signal is applied to the drive control unti 12. The sewing machine stops.

Additionally, by reason of the interconnection of the gates 58, 60, the speed-limiting flip-flop 59, 60 reverts to the "no speed limiting" state thereof. The foot-pedal being in backwards-tilted position, the cooperating normally-closed switch 156 (FIG. 3) is open, and accordingly a signal is applied via the gate 164, via the line 165 and via the gate 166 to the gate 182. By way of the gate 183 there appears a "1" signal at the output of gate 184, this signal after passing through the inverter 187 constituting a "cut thread" command signal activating the thread cutting control unit 25. The thread is cut, and the sewn article can be removed from the sewing machine.

If an automatic seam-sewing operation is to be terminated before completion, for example as a result of wrong positioning of the seam, tilting backwards of the foot pedal and concomitant opening of the normally closed switch 156 (FIG. 3) causes the sewing-direction information-storing flip-flop 53, 54 to undergo a change of state, in consequence of which the motor-flip-flop 57, 58 undergoes a transition to the "turn off drive" state. By way of the gate 185, the lower input of which is connected to ground via line 186 and control switch 28, a "1" signal is immediately applied to the gate 184, which in turn and by way of the inverter 187 activates the thread cutting control unit 25. The thread is accordingly automatically cut off, without having to wait for a "seam finish lock" to be sewn.

Now, if a new automatic seam sewing operation is initiated, then the pulse resulting from opening of the normally closed switch 70 again causes the complete seam stitch number registered in the storages 162, 163 to be transferred into the seam stitch counter 91, 92. This means that, upon initiation of this new automatic seam-sewing operation, the entire preprogrammed number of seam stitches will be sewn, irrespective of whether the preceding automatic seam-sewing operation was completely performed or interrupted in the manner just described.

Additionally, it is also possible to merely interrupt the automatic seam-sewing operation, i.e., to temporarily arrest the seam-sewing operation and then cause the operation to resume and proceed to completion. This can be done by bringing the foot-pedal to the neutral position thereof, in which both normally closed switches 70, 156 (FIG. 3) are closed. In such event, the sewing machine is arrested. If thereater the foot pedal is tilted forwards, opening the normally closed switch 70 (FIG. 3), the partially completed automatic seam-sewing operation proceeds to completion.

The gate 211 (FIG. 3) serves to suppress the seam lock termination signal associated with the "seam start lock," since upon completion of the "seam start lock" the speed-limiting flip-flop 59, 60 is not yet in the "speed-limiting" state thereof. The gate 212, connected to the output of gate 211, enables the turning on the motor-flip-flop 57, 58 in the case of seam lengths having a stitch number smaller than three, since in such case the first seam lock termination pulse is blocked.

If no "seam start lock" is desired, then, in contrast to the operation described above, the selector switch 22 (FIG. 6) is set to the position corresponding to zero stitches. After the foot-pedal is tilted forwards, with concomitant opening of switch 70 (FIG. 3), there will be a "0" signal at the output of gate 62 of the seam-lock flip-flop 61, 62. As a result, by way of the line 79, the gate 132 will undergo a change of state. The output signal of gate 132 will be a "1" signal, and the output signal of the gate 133, connected thereto, will be a "0" signal. The reset pulse on line 85 causes a "1" signal to appear at the output of a NOR-gate 213, as a result of which a "0" signal appears at the output of gate 139. By way of the gate 63 and the line 64, the flip-flop 66 is caused to revert to "0", i.e., to the "no seam lock" state thereof. The automatic sewing of the main body of the seam begins, without the sewing an initial "seam start lock".

Figure 2:
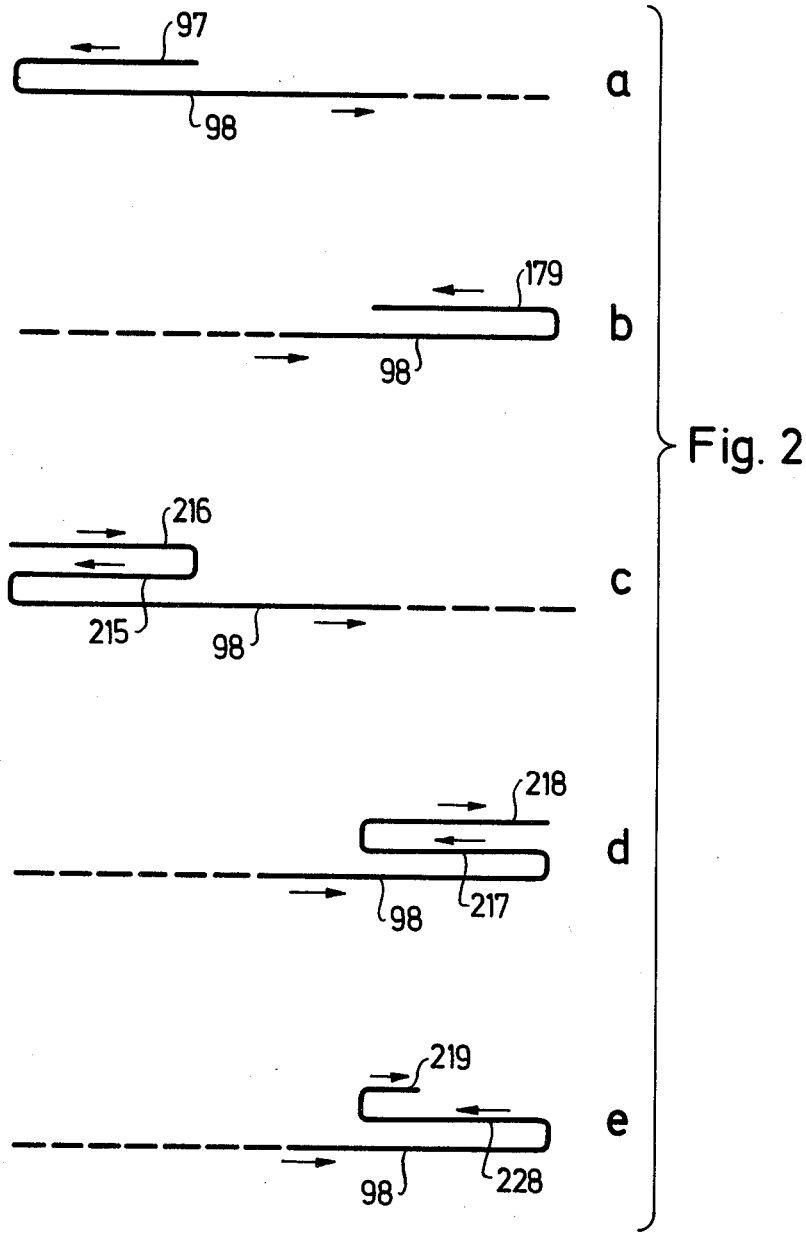
FIGS. 2*a* to 2*e* are schematic illustrations of different types of seam-start and seam-finish end-of-seam seam-locking stitch arrangements.

The automatic seam lock control arrangement 10 is also capable of causing the "seam start lock" to be sewn in the form of a double seam lock, i.e., a "seam start lock" such as depicted in FIG. 2*c*, and consisting of a series of seam-end-locking stitches 215 sewn in backwards direction (as in the case of the half lock 97 of FIG. 2*a*) preceded by a series of seam-end-locking stitches 216 sewn in forwards direction, the number of stitches in the two rows 215 and 216 happening to be equal in the illustrated embodiment.

In order to effect automatic sewing of such a double lock at the start of the seam, the selector switch 22 is moved to a position corresponding to the desired number of locking stitches, whereas the selector switch 20 is moved to the right position in FIG. 6. The foot-pedal is tilted forwards, the switch 70 (FIG. 3) opens, and the flip-flop 61, 62 assumes the "seam start lock" state thereof "1" signals are applied to both inputs of gate 101 (FIG. 6) and accordingly a "0" signal appears at the output of gate 101. The inverter 102 supplies a "1" signal to the exclusion OR-gate 103. If the flip-flop 88 is set to zero by means of the reset pulse on line 85 resulting from the change of state of flip-flop 61, 62, then there exists at the output of the gate 103 a "0" signal. The gate 104 applies a "0" signal to the input of the sewing-direction control unit 24, i.e., a "forwards" command signal. As a result, the row of locking stitches 216 (FIG. 2*c*) is sewn in forwards direction. The synchronizer pulses arriving via line 131 are counted, until the number corresponding to the position of selector switch 22 (the number of stitches for the "seam start lock") is reached. Thereupon, there appears at the output of the selector switch 22 a coincidence pulse which is applied firstly via the gates 132, 133, 134 to the flip-flop 88, causing a "1" signal to appear at the output Q of flip-flop 88, and is applied secondly via the gates 132, 133, 86 to the reset input "res" of lock stitch counter 87, thereby resetting counter 87 to zero. Now, "1" signals are applied to both inputs of the gate 103, and accordingly the output signal thereof becomes a "0" signal. As a result, there appears at the output of gate 104 a "1" signal. Accordingly, the sewing-direction control unit undergoes a transition to its "backwards" state.

Now, once again, a number of synchronizer pulses corresponding to the setting of selector switch 22 is counted, and upon coincidence of the energization of the output of decoder 130 (FIG. 6) corresponding to the setting of switch 22, another such coincidence pulse appears at the output of switch 22 (at the moving switch contact thereof), thereby resetting the flip-flop 88 and the counter 87 back to zero. Additionally, the signal applied to the input of sewing-direction control unit 24 changes from "1" to "0". The negative flank of this pulse change, by way of the gate 137 (FIG. 6), triggers the monostable multivibrator 138, which latter serves for transmitting the seam lock termination pulse to the flip-flop 66. The body of the seam 98 (FIG. 2*c*) is then automatically sewn in the manner described already.

If there is to be no "seam finish lock", the selector switch 23 (FIG. 6) is set to the zero position thereof. When the end of the seam is reached, the flip-flop 61, 62 will be in the "seam finish lock" state thereof. In consequence thereof, there will be a "0" signal on the line 82, so that there will be a "1" signal at the output of NOR-gate 180 and a "0" signal at the output of NOR-gate 133. If a reset pulse generated upon reaching the seam end appears on the line 85 (FIG. 6), then a "1" signal appears at the output of the NOR-gate 213 (FIG. 6). The output signal of the NOR-gate 139 becomes a "0" signal. By way of the line 64 the flip-flop 66 is reset to zero. The automatic thread-cutting operation is initiated, without any "seam finish lock" being sewn.

As was the case with the "seam start lock", the "seam finish lock" can be sewn in the form of a double lock (FIG. 2d) composed of a first row 217 of seam-end-locking stitches sewn in backwards direction, followed by a second row 218 of seam-end-locking stitches sewn in forwards direction. To this end, the selector switch 23 is set to a position corresponding to the desired number of "seam finish lock" stitches, whereas the selector switch 21 is moved to the right position shown in FIG. 6.

When the "seam lock" flip-flop 61, 62 has undergone a transition into the "seam finish lock" state thereof, the lower input of gate 136 (FIG. 6) receives a "0" signal via switch 21 and the upper input of gate 136 receives a "0" signal via line 82. The gate 136 accordingly applies a "1" signal to the lower input of the gate 137. If upon reaching the seam end a reset pulse appears on line 85, then a "1" signal, constituting a "backwards" command signal, is applied in the above described manner to the input of sewing-direction control unit 24. Simultaneously, a "0" signal appears at the output of gate 137. Unless special precautions are taken, this "1" to "9" transition at the output of gate 137 would immediately trigger the monostable multivibrator 138, thereby generating a seam-lock termination pulse. This is prevented by discharging timing capacitor 220, during a time period other than the time period of the sewing of a seam lock, through a diode 221 and an exclusive OR-gate 222. The upper input of gate 222 is continuously maintained at logic level "1", whereas the lower input of gate 22 is connected via line 181 to the output $\overline{Q}$ of the flip-flop 66. During the time period in which a seam lock is being sewn, the capacitor 220 must first charge through a resistor 223, and only thereafter will the transition from a "1" signal to a "0" signal at the output of gate 137 be capable of triggering the monostable multivibrator 138.

There are counted now the stitches of the row 217 of seam-locking stitches preselected by means of the selector switch 23. When the desired number of stitches is reached, the flip-flop 88 undergoes a change of state. A "forwards" command signal is applied to the input of the sewing-direction control unit 24. A "1" signal appears at the output of gate 137. The seam-locking stitch counter 87 was set to zero by the coincidence pulse generated when a "1" signal appeared on that output of decoder 130 (FIG. 6) corresponding to the setting of switch 22. The same preselected number of synchronizer pulses are counted, once more now, before the next such coincidence pulses causes the flip-flop 88 to revert to zero state. Accordingly, the sewing-direction control unit 24 would be caused to undergo a transition to "backwards" state. However, with conventional, commercially available sewing machines, the sewing-direction control units which are provided are so sluggish when undergoing a change of state that, before the unit 24 can undergo a transition to the "backwards" state, the flip-flop 66 causes a "1" signal to be applied to line 181, so that the sewing-direction control unit 24 simply remains in its "forwards" state. The change of the output signal of gate 104 from "1" to "0" causes the output signal of gate 137 to change from "1" to "0". The monostable multivibrator 138 is thereby triggered and generates a seam-lock termination pulse which, via line 64, is applied to the flip-flop 66 and resets the latter.

Many commercially available sewing-direction control units 24 are comprised of a two-position pneumatic switchover valve. Many of such pneumatic control units 24 require for a "forwards"to "backwards" change of state a time different than required for a "backwards" to "forwards" change of state. For example, this may be because the pneumatic valve, whose depressurized condition corresponds to normal sewing in forwards direction, can be pressurized more quickly than it can be depressurized. If no special precautions are taken, this characteristic can have the result that, when automatically sewing a double lock at the end of the seam, more stitches will be sewn in the backwards direction than called for by the program, and the double seam lock will be unsymmetrical. To counteract this possible effect, there is provided a monostable multivibrator 226 (FIG. 6) having a synchronizing-signal input "*d*" connected via a line 79 with the output of gate 62 of flip-flop 61, 62 and consequently maintained at logic level "1" during the sewing of the "seam finish lock". The input A of the monostable multivibrator 226 (FIG. 6) is connected to the output of gate 104. The monostable multivibrator 226 is triggered when the output signal of gate 104 changes from "1" to "0". For the duration of its metastable state, the monostable multivibrator 226 prevents the monostable multivibrator 114 from responding to the synchronizer pulses applied thereto via line 113. In other words, when the sewing-direction control unit 24 undergoes a transition from "backward" state to "forwards" state, a certain number of synchronizer pulses, for example two pulses, are suppressed by means of the monostable multivibrator 226 (FIG. 6).

Finally, the illustrated exemplary automatic seam lock control arrangement permits the automatic sewing of a so-called chain-stitch seam lock (FIG. 2*e*). This type of seam lock is resorted to when a double lock (FIG. 2*d*) is not necessary but the automatic thread-cutting arrangement is only capable of cutting a thread when the sewing machine is operating in the forwards direction. If a chain-stitch seam lock (FIG. 2*e*) is to be sewn, then when the seam end is reached there is first sewn in the backwards direction a half lock 228, followed by the sewing in the forwards direction of a number of locking stitches 219 independent of the number of backwards-sewn stitches 228; for example, three such stitches 219 are sewn in the forwards direction.

To effect automatic sewing of a chain-stitch seam lock, the selector switch 23 is set to a position corresponding to the desired number of seam-locking stitches, whereas the switch 21 is moved to the middle position thereof (FIG. 6). The row of stitches 228 (FIG. 2*e*) is sewn in the aforedescribed manner in the backwards direction. When the preselected number of locking stitches has been reached, the coincidence pulse appearing at the output of switch 23 (at the moving switch contact of switch 23) causes the flip-flops 88 and 89 to undergo a change of state. After the monostable multivibrator 226 has blanked out the synchronizer pulses for the two first stitches of the row of stitches 219, upon the next counting operation after the first counted stitch a NOR-gate 230 is energized, since the line 82 and the output 1 of decoder 130 are at logic level "0". From the output of the gate 230 a "1" signal is applied to a NAND-gate 231. Since the flip-flop 89 is in the "1" state thereof, on account of the aforedescribed coincidence pulse, with a "1" signal at the output of inverter 232 on account of the position of switch 21, there is applied from the gate 231 a "0" signal to the gate 134. The flip-flop 88 undergoes a change of state. In the aforedescribed manner, the sewing-direction control unit 24 undergoes a change of state, the seam lock termination pulse is generated and the thread-cutter control unit 25 is activated.

Figure 7:
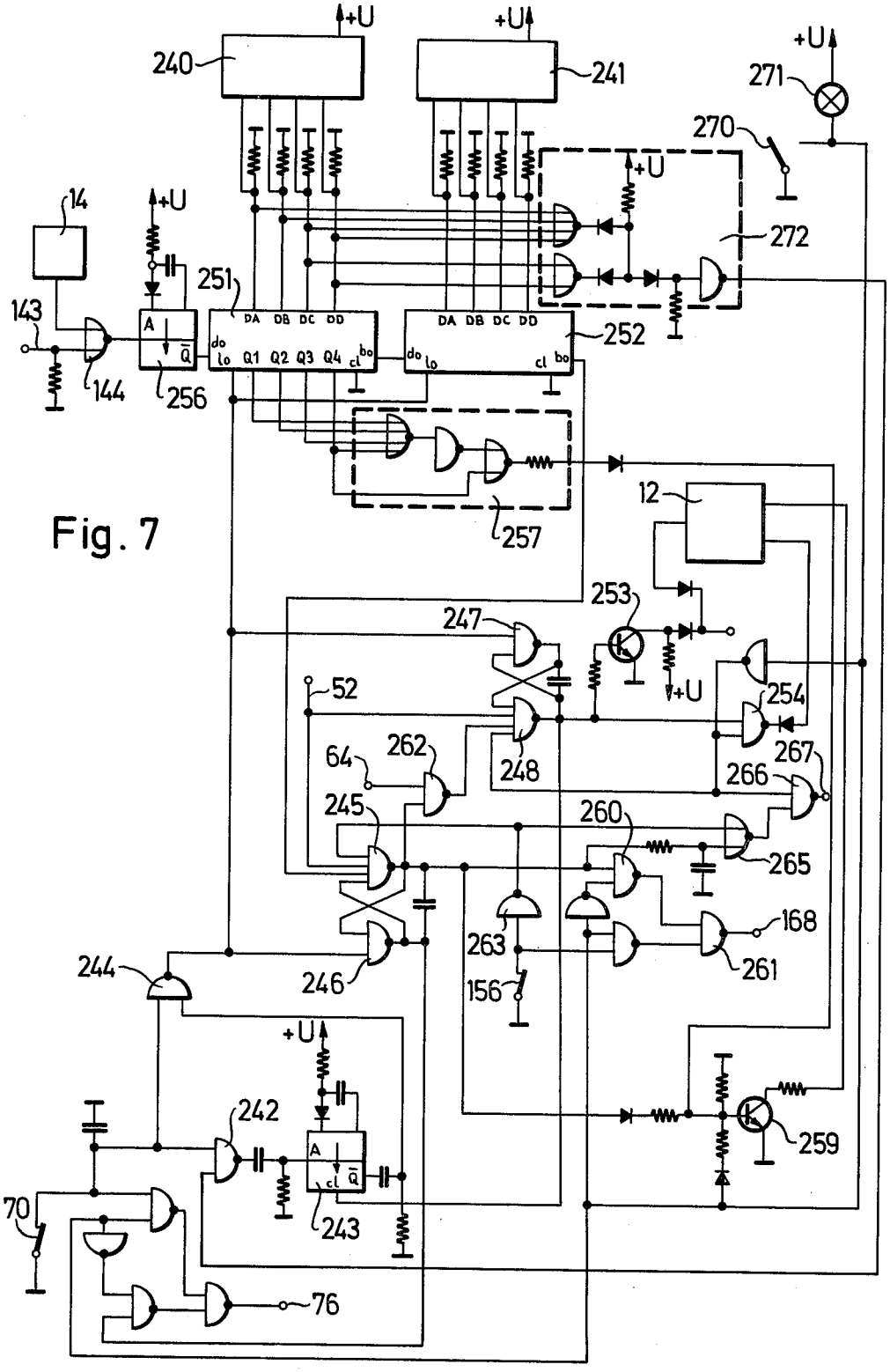
FIG. 7 depicts a modified version of a portion of the circuit of FIGS. 1 and 3–6.

FIG. 7 depicts a modified form of the automatic seam length control arrangement 11. Two selector switches 240, 241 are provided, by means of which the desired seam length, expressed in terms of the number of stitches in the seam, can be numerically preselected. Accordingly, the establishment of the seam length is effected not by first sewing a "model" seam, but instead by setting the seam-length-selecting switches 240, 241 to the desired number of stitches. The automatic seam length control arrangement of FIG. 7 is directly connectable to the automatic seam lock control arrangement depicted in FIGS. 3–6, the latter not being redepicted, for the sake of simplicity.

When the foot-pedal is tilted forwards, the switch 70 (FIG. 3) of the foot-pedal control arrangement 35 opens. A "1" signal appears at the upper input of a NAND-gate 242 (FIG. 7), thereby triggering a monostable multivibrator 243. At the end of the metastable state of the monostable multivibrator 243, a negative pulse ("0" signal) appears at the output of a NAND-gate 244. This pulse triggers a flip-flop comprised of NAND-gates 245, 246, and simultaneously a motor-flip-flop comprised of NAND-gates 247, 248 undergoes a transition into the "drive turned on" state thereof. The pulse at the output of gate 244 is furthermore applied to the loading inputs "lo" of forwards-backwards counters 251, 252. As a result, the preselected number set on switches 240, 241, indicating the desired seam length as expressed in the number of stitches thereof, and present in binary-coded form on the outputs of the switches 240, 241, is transferred to the counters 251, 252. Additionally, by way of the output of the gate 248 a transistor 253 is rendered conductive. The transistor 253 furnishes to the drive control unit 12 a voltage indicative of the desired drive speed. Furthermore, by way of the output of the gate 248 a NAND-gate 254 is caused to undergo a change of state, resulting in a termination of the blocking of the drive control unit 12, which up till then was in effect.

After the "seam start lock" has been sewn, in the manner described above with respect to FIGS. 3–6, the NOR-gate 144 is unblocked by means of the signal arriving via line 143. Consequently, the synchronizer pulses coming from synchronizer 14 are transmitted to a monostable multivibrator 256. The monostable multivibrator 256 serves as a pulse shaper, converting the received synchronizer pulses into corresponding pulses of constant magnitude and pulse duration, in order to prevent faulty counting by the counters 251, 252 such as could result from synchronizing pulses having insufficiently steep flanks. The counting pulses are applied from the output $\overline{Q}$ of the monostable multivibrator 256 to the backwards counting input of the counter 251, 252. The counter 251, 252 accordingly counts backwards, starting from the number corresponding to the setting of switches 240, 241, until a predetermined remainder value, for example eight, has been reached. When this predetermined remainder value is reached, a number decoding stage 257 connected to the outputs of the units counter 251 generates an output signal which renders transistor 259 conductive. At the output of the transistor 259 there appears a signal which is applied to the drive control unit 12 and serves to limit the drive speed for the last eight stitches at the seam end.

When the counters 251, 252 have counted down to such an extent that there appears at the output "bo" a run-under pulse, the flip-flop 245, 246 becomes reset. At the output of gate 245 there appears a "1" signal. There appears a "0" signal at the output of a NAND-gate 260, one of whose inputs is connected to the output of the gate 245. At the output of a NAND-gate 261 connected to the output of the gate 260 there appears a "1" signal which is applied to line 168 and corresponds to the signal which is generated, in the circuit of FIGS. 3–6, in response to backwards tilting of the foot-pedal. Accordingly, when the end of the seam is reached, the automatic seam lock control arrangement automatically undergoes a transition into the state thereof necessary for the automatic sewing of a "seam finish lock." The "seam finish lock" is sewn in the aforedescribed manner, whereupon there appears on the line 64 the seam lock termination signal (a positive pulse). This pulse via a NAND-gate 262 effects resetting of the motor-flip-flop 247, 248. By way of the gate 254 the drive control unit 12 is blocked. The drive is arrested. Additionally, the thread is automatically cut in the manner already explained with reference to FIGS. 3–6.

If, during the automatic sewing of the seam, the sewing machine is to be temporarily arrested, for example because the thread has slipped out of the sewing needle, then the foot-pedal is tilted backwards. The normally closed switch 156 opens. A "1" signal appears at the output of an inverter 263 and is applied to the input of gate 245 causing resetting of the flip-flop 245, 246. As a result there are applied to the two inputs of a NOR-gate 265 two phase-shifted signals, as a result of which an output pulse is generated and transmitted via a NAND-gate 266 to an output 267 connected to one input of the gate 63 (FIG. 6). As a result, there again appears on the line 64 the positive stitch lock termination pulse which, by way of the gate 262, causes the motor-flip-flop 247, 248 to undergo a transition into the "drive turned off" state thereof. As a result, and by way of the gate 254, the drive is arrested. A switch 270 is provided to render inoperative the automatic seam length control arrangement, when the seamstress wishes to operate the machine independently of the program stored in the automatic control arrangement. The fact that the automatic control arrangement has been rendered operative is indicated by lamp 271.

A switch-setting decoder stage 272 prevents the sewing of too short seams. In the illustrated exemplary embodiment, the shortest seam which can be automatically sewn is four stitches long. When the selector switches 240, 241 are jointly set for a number smaller than four, a "0" signal appears at the output of decoder 272. By means of this "0" signal, the gate 242 is blocked, so that when the foot-pedal is tilted forwards the "1" signal resulting from opening of foot-pedal-controlled switch 70 cannot pass through the gate 242 and accordingly cannot trigger the monostable multivibrator 243.

If the automatic seam length control arrangement is to be employed for sewing square seams, and if the successive longitudinal and transverse seam portions are to have different lengths, then, in addition to the selector switches 240, 241, a further pair of selector switches can be provided. In that case, one pair of switches serves to set the length of the longitudinal seam portion while the other pair of switches serves to set the length of the transverse seam portion. A suitable logic unit can be provided operative for causing the two numbers set on such two pairs of switches to be alternately transferred into the counter 251, 252. Additionally, in such case, the control logic of the arrangement can be so designed that each time the first three seams of the square have been sewn, the foot pedal of the sewing machine is automatically lifted.

An automatic seam length control arrangement of the type depicted in FIG. 7 can be used not only in place of but also to supplement an automatic seam length control arrangement such as depicted in FIGS. 3–6, so that the seam length can be established either by the initial sewing of a "model" seam or else by manually setting various selector switches, as desired.

If the arrangement is to be mass produced, it is additionally contemplated to permanently program into the automatic control arrangement one or more predetermined programs by means of corresponding permanent wiring arrangements.

It will be understood that each of the elements described above, or two or more together, may also find a useful application in other types of circuits and constructions differing from the types described above.

While the invention has been illustrated and described as embodied in an automatic seam length and seam lock control arrangement for a sewing machine, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention and, therefore such adaptations should and are intended to be comprehended within the meaning and range of equivalence of the following claims.

What is claimed as new and desired to be protected by Letters Patent is set forth in the appended claims:

1. In combination with a sewing machine having a drive means, a control arrangement for the sewing machine, comprising, in combination, lock-type selector means having a plurality of manually selectable settings selectable by the user of the sewing machine for selecting different types of seam-end locks; stitch-number selector means having a plurality of manually selectable settings selectable by the user of the sewing machine for selecting numbers of stitches in seam-end locks; and drive control means connected to said drive means and to said selector means and activatable by the user of the sewing machine for causing the sewing machine to automatically sew a seam having a predetermined number of stitches including at at least one of the two ends of the seam a seam-end lock of the type corresponding to the setting of said lock-type selector means and comprised of a number of stitches determined by the setting of said stitch-number selector means.

2. The combination defined in claim 1, wherein said lock-type selector means selects the number of rows of stitches in seam-end locks, wherein said stitch-number selector means selects the number of stitches in rows of stitches, and wherein said drive control means comprises means activatable by the user of the sewing machine for causing the sewing machine to automatically sew a seam having a predetermined number of stitches including at at least one of the two ends of the seam a seam-end lock of the type and comprised of a number of rows of stitches corresponding to the setting of said lock-type selector means with the number of stitches in each row of stitches of the seam-end lock being dependent upon the setting of the stitch-number selector means.

3. The combination defined in claim 1, wherein said stitch-number selector means comprises first stitch-number selecting means having a plurality of manually selectable settings selectable by the user of the sewing machine for selecting first stitch numbers and second stitch-number selecting means having a plurality of manually selectable settings selectable by the user of the sewing machine for selecting second stitch numbers, and wherein said drive control means comprises means activatable by the user of the sewing machine for causing said sewing machine to automatically sew a seam having a predetermined number of stitches including at the first end of the seam a first seam-end lock comprised of a number of stitches corresponding to the setting of said first stitch-number selecting means and at the second end of the seam a second seam-end lock comprised of a number of stitches corresponding to the setting of said second stitch-number selecting means.

4. The combination defined in claim 1, wherein said lock-type selector means comprises first stitch-number selecting means and second stitch-number selecting means, wherein said stitch-number selector means comprises first lock-type selecting means and second lock-type selecting means, each having a plurality of settings selectable by the user of the sewing machine for selecting, respectively, first stitch numbers, second stitch numbers, first seam-end lock types and second seam-end lock types, and wherein said drive control means comprises means activatable by the user of the sewing machine for causing said sewing machine to automatically sew a seam having a predetermined number of stitches including at the first end of the seam a first seam-end lock of a type corresponding to the setting of said first lock-type selecting means and comprised of a number of stitches dependent upon the setting of said first stitch-number selecting means and at the second end of the seam a second seam-end lock of a type corresponding to the setting of said second lock-type selecting means and comprised of a number of stitches dependent upon the setting of said second stitch-number selecting means.

* * * * *